United States Patent [19]

Theodore

[11] 3,938,717

[45] Feb. 17, 1976

[54] MAGAZINE HOLDER

[76] Inventor: Paris Theodore, 24 E. 73rd St., New York, N.Y. 14304

[22] Filed: Feb. 1, 1974

[21] Appl. No.: 438,656

[52] U.S. Cl. ..... 224/13; 206/350; 206/818; 224/5 R; 224/26 R; 248/206 A

[51] Int. Cl.[2] ..... F42B 39/00

[58] Field of Search..... 224/2 B, 2 D, 2 E, 2 F, 224/23, 13, 4 C, 5 R, 5 A, 5 B, 26 R, 26 B, 14, 15, 17, 20, 22, 25 R; 211/DIG. 1; 206/818, 350; 248/206 A, 309

[56] References Cited

UNITED STATES PATENTS

| | | | |
|---|---|---|---|
| 1,310,377 | 7/1919 | Sisson | 224/23 |
| 1,894,540 | 1/1933 | Peirce | 224/2 F |
| 3,008,617 | 11/1961 | Villwock | 224/2 B |

FOREIGN PATENTS OR APPLICATIONS

| | | | |
|---|---|---|---|
| 1,220,799 | 1/1971 | United Kingdom | 211/DIG. 1 |
| 755,351 | 8/1956 | United Kingdom | 211/DIG. 1 |
| 580,976 | 8/1959 | Canada | 224/2 B |

*Primary Examiner*—Robert J. Spar
*Assistant Examiner*—Jerold M. Forsberg
*Attorney, Agent, or Firm*—James A. de Peyster, Jr.

[57] ABSTRACT

A cartridge magazine holder including a magnet to hold a pair of cartridge magazines with large portions of the magazines exposed so that they may be easily grasped and withdrawn by the user. The magazine holder rides high on the belt of the wearer and holds the magazine flat against the body for easy concealment.

8 Claims, 3 Drawing Figures

MAGAZINE HOLDER

This invention relates to cartridge magazine holders, and more particularly, to concealable cartridge magazine holders from which the cartridge magazines may be quickly, easily and securely withdrawn.

One type of conventional magazine holder is the simple stitched leather belt pouch having a top flap that fastens down over the magazine or magazines to retain them in position. A disadvantage of this type of magazine holder is that the top flap must be unfastened before the magazine can be withdrawn. Since speed of reloading may be vital in a combat situtation, the delay caused by the need for unfastening the top flap is undesirable and it may possibly be fatal.

Another conventional type of magazine holder is the open-top belt pouch which is also typically made of stitched leather and holds one or more cartridge magazine in a vertical inverted position with their base portions exposed so that they may be immediately grasped and withdrawn by the wearer. The open-top magazine case depends upon snugness of fit to retain the magazines in position in spite of vigorous movements of the wearer.

One problem of conventional open-top magazine cases is that proper fit is difficult to achieve and is critical to the proper functioning of the magazine case. If this fit is too loose the magazine may fall out. If the fit is too tight, the wearer may have difficulty in extracting the magazine for use. The problem of fit is further compounded by the fact that, even for cartridges of the same caliber, magazines of different manufacturers have different outside dimensions so that magazine cases must be specially fitted to the magazines of each manufacturer.

Another problem of pouch-type magazine cases is that they tend to accumulate litter or debris which tends to foul the cartridges and may interfere with the operation of a pistol. Pouch type magazine cases also tend to collect moisture which may corrode the cartridges. Also, if the first cartridge in the magazine rests against the bottom of the pouch, it may tend to become disaligned with the magazine lips so that when the magazine is inserted into the pistol, the first cartridge will not feed properly.

It is therefore the object of this invention to provide an improved cartridge magazine holder which obviates the problems of the prior art.

It is also an object of this invention to provide a cartridge magazine holder that holds the magazines securely and reliably but allows them to be quickly and easily withdrawn for use.

It is a further object of this invention to provide a belt-worn magazine holder that is easily concealed beneath the clothing of the wearer.

It is yet another object of this invention to provide a magazine holder of simplified construction that is capable of accommodating magazines having moderate size variations.

According to the above and other objects, the present invention provides a magazine holder that is worn high on the belt of the wearer and includes a magnet for retaining a pair of cartridge magazines in the vertical inverted position. The sides of the subject magazine holder are cut away to enable the user to obtain a secure four-finger grip on each magazine prior to withdrawing it so as to reduce the chance of fumbling during reloading. The subject magazine holder is preferably made of a single piece of leather, or other suitable material and is of stitchless construction for ease of manufacture and of long life.

Other objects and advantages of the present invention will be apparent from the following detailed description and accompanying drawings which set forth the principle of the present invention and the best mode contemplated for carrying out that principle.

In the Drawings

Figure 1:
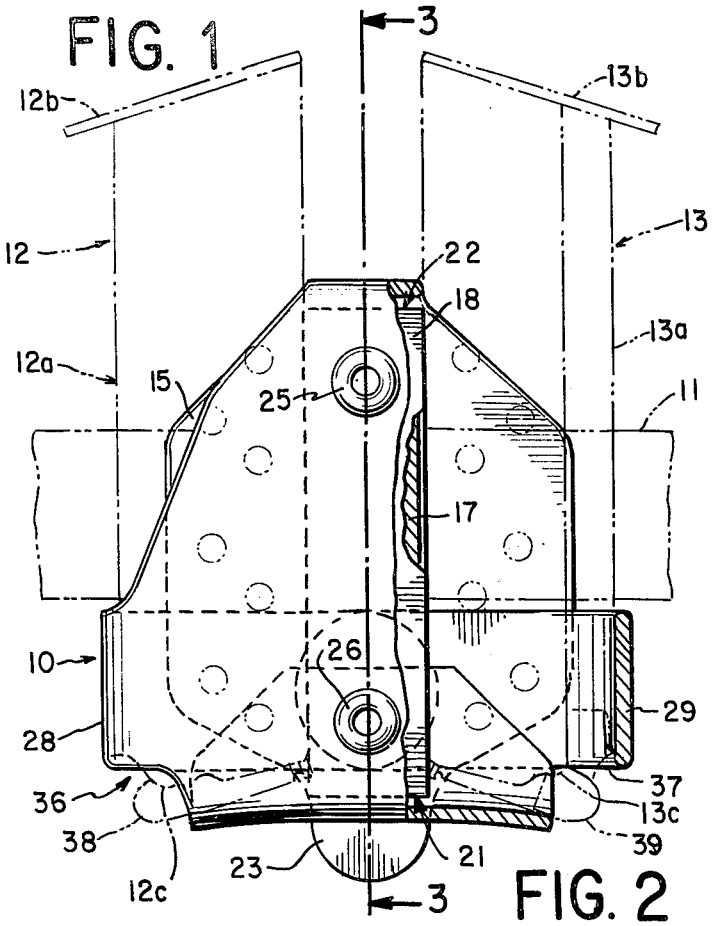
FIG. 1 is a side elevation view of the outside of the subject magazine holder partially broken away to show the magnet assembly.

Referring in detail to the drawings, FIG. 1 shows the subject magazine holder, generally designated 10, mounted on a belt 11 shown in phantom lines. The magazine holder 10 holds a pair of cartridge magazines 12 and 13 in the vertical inverted position. The magazine holder 10 is preferably made of a single piece of a suitable poromeric material such as, for example, 2–3 oz. Corfam originally manufactured by Du Pont Corporation of Wilmington, Delaware, Aztran manufactured by B.F. Goodrich Co. of Akron, Ohio or Porvair manufactured by the Goodyear Co. of Akron, Ohio. Alternatively, the sheet material 15 may be made of 5–6 oz. leather or 2–5 oz. polypropylene or polyethylene sheet material.

The cartridge magazines 12 and 13 are retained in position by a magnet assembly preferably comprising a rubber magnet 17 sandwiched between two steel plates 18 and 19. Such a magnet assembly 17–19 is manufactured by Owen & Morris, Inc., of New York, New York. It will be appreciated, however, that other types of magnets may be used within the spirit and scope of the present invention.

The single piece of sheet material 15 is wrapped around the bottom 21 of magnet assembly 17–19, up the outside of magazine case 10 overlying the steel plate 18, over the top 22 of magnet assembly 17–19 and down the inside of magazine case 10. The end 23 of sheet material 15 forms a tab which can be used for unsnapping the magazine holder 10 from the belt 11 of the wearer.

Figure 2:
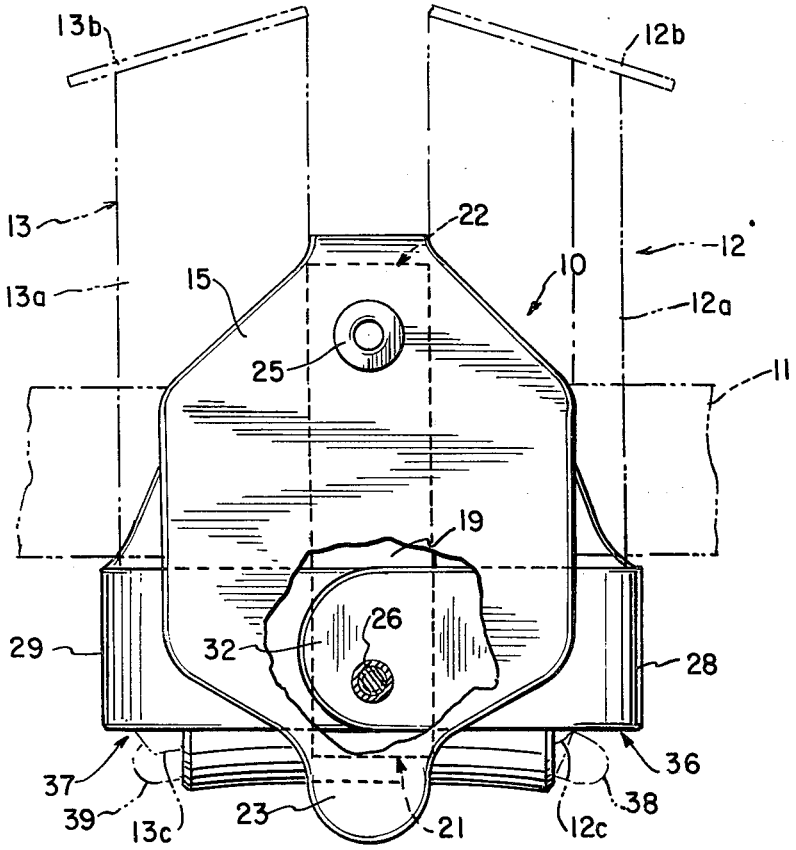
FIG. 2 is a side elevation view of the inside of the subject magazine case partially broken away to show other details of the construction.

Sheet material 15 is fastened to the magnet assembly 17–19 by a pair of rivets 25 and 26. Sheet material 15 includes a pair of tabs that extend at right angles to the main axis of the piece and are wrapped around the magazine tubes **12*a* and 13*a* to form retaining loops 28 and 29 as shown in FIGS. 1 and 2. The ends 31 and 32 of loops 28 and 29 are secured to the magnet assembly 17–19 by a rivet 26** or other suitable fastening means.

Figure 3:
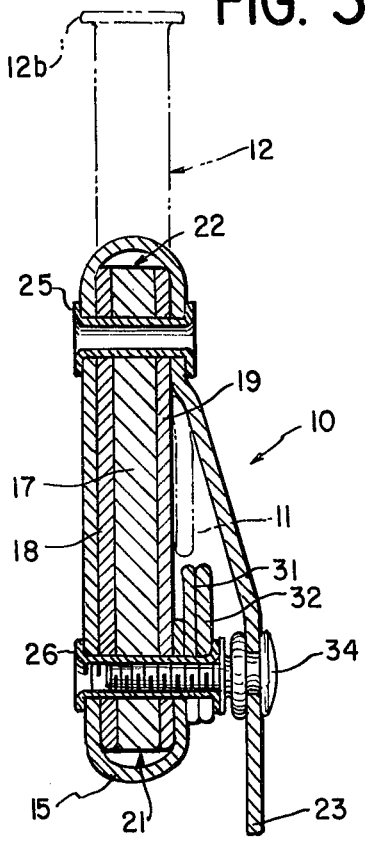
FIG. 3 is a cross-sectional view taken along the line 3—3 of FIG. 1.

Tab end 23 of sheet material 15 is releasably fastened to the body of magazine holder 10 by a snap fastener 34. Snap fastener 34 may be of a conventional type, such as for example the Dot fasteners manufactured by the United Carr Fastener Corp., of New York, New York. In the preferred embodiment shown in FIG. 3 the female portion of the snap fastener 34 is mounted on tab end 23 of sheet material 15 while the male portion of snap fastener 34 is mounted on rivet 26. Snap fastener 34 is preferably a "one-way" snap fastener that can be opened only by pulling tab 23 away from the body of magazine holder 10. The use of a one-way snap fastener provides security in the mounting of magazine holder 10 on belt 11 because the one-way snap fastener 34 will not unsnap when the magazine holder 10 is pulled away from belt 11.

It is noted that the design of the magazine holder 10 is such that its lower part in the region of rivet 26 is thicker than its upper part in the region of rivet 25. More particularly, snap fastener 34 projects toward the body of the wearer and thereby serves to wedge the bases 12*b* and 13*b* of the magazines 12 and 13 against the body of the wearer. This feature of the subject magazine holder 10 plus the flat orientation of the magazines 12 and 13 promotes easy concealment beneath the clothing of the wearer.

It is also noted that the design of the subject magazine case 10 leaves a great portion of the magazines 12 and 13 exposed to the immediate grasp of the wearer. This permits the wearer to obtain a very secure four-fingered grip on the magazine prior to withdrawing it from holder 10. Moreover, the user can retain the same grip on the magazine until he inserts it into the pistol. The fact that the subject magazine holder 10 permits the user to obtain a secure grip that need not be shifted during the reloading operation tends to eliminate fumbling that could be dangerous or even fatal to a user involved in a combat situation.

It is also noted that the design of the subject magazine holder 10 provides opening 36 and 37 at the bottom of each magazine loops 28 and 29 respectively. The openings 36 and 37 provide ventilation and drainage and prevent debris from accumulating. Thus, openings 36 and 37 help to prevent corrosion and/or fouling of the cartridges 38 and 39. Moreover, the noses of cartridges 38 and 39 are able to partially project through openings 36 and 37 so that the cartridges 38 and 39 can keep their normal position between the lips 12c and 13c of magazines 12 and 13 respectively. Hence, openings 36 and 37 of magazine holder 10 help to reduce the chance of jamming a pistol due to a misaligned first cartridge.

Although the principle of the present invention has been illustrated by reference to a preferred embodiment of the subject magazine case, it will be appreciated by those skilled in the art that various modifications and adaptations can be made within the spirit and scope of the present invention which is set forth with particularity in the appended claims.

What is claimed is:

1. A cartridge magazine holder comprising:

a magnetic member having a pair of elongated rigid pole-pieces for magnetically engaging a side of a cartridge magazine so as to hold the magazine in parallel alignment with the long axis of said magnetic member;

a piece of flexible sheet material mounted on said magnetic member so as to form a loop extending around the cartridge magazine to hold the cartridge magazine in alignment with said magnetic member and prevent lateral withdrawal or shifting of the magazine while allowing the magazine to be withdrawn base-first in a direction parallel to the long axis of said magnetic member, said loop leaving the nose of the first cartridge exposed so as not to disturb its alignment with the lips of the magazine, and leaving a sufficient portion of the base of the cartridge magazine exposed to allow a user to securely grasp the magazine for withdrawal; and means for mounting said magazine holder on the belt of a user.

2. The cartridge magazine holder of claim 1 wherein one side of said magnetic member magnetically engages a first cartridge magazine and the opposite side of said magnetic member magnetically engages a second cartridge magazine, and said piece of flexible sheet material is mounted on said magnetic member so as to form a pair of loops for holding the cartridge magazines in alignment with said magnetic member.

3. The cartridge magazine holder of claim 2 wherein said mounting means comprises:

a tab end of said piece of sheet material; and means for releasably fastening said tab end of said piece of sheet material to the lower inside portion of said magazine holder to form a belt loop.

4. The cartridge magazine holder of claim 3 wherein said releasable fastening means comprises a one-way snap fastener.

5. The cartridge magazine holder of claim 4 wherein the lower inside portion of said magazine holder projects toward the body of the user so as to wedge the upper ends of the cartridge magazines toward the body of the user to permit easy concealment beneath the clothing of the user.

6. The cartridge magazine holder of claim 1 wherein said sheet material is selected from the group consisting of Aztran, Corfam, Porvair, leather, polyethylene and polypropylene.

7. The cartridge magazine holder of claim 1 wherein said magnetic member comprises a rubber magnet sandwiched between a pair of elongated steel plates, said steel plates comprising the pole pieces of said magnetic member.

8. The cartridge magazine holder of claim 7 wherein said magnetic member is at least 2 inches long.

* * * * *